US006968968B2

(12) United States Patent
Buckley et al.

(10) Patent No.: US 6,968,968 B2
(45) Date of Patent: Nov. 29, 2005

(54) CONTAINER CLOSURE ASSEMBLY WITH SNAP-ON OVERCAP

(75) Inventors: Simon Buckley, Wayne, IN (US); Richard A. Laveault, Wayne, IN (US)

(73) Assignee: Rieke Corporation, Auburn, IN (US)

( * ) Notice: Subject to any disclaimer, the term of this patent is extended or adjusted under 35 U.S.C. 154(b) by 22 days.

(21) Appl. No.: 10/662,735

(22) Filed: Sep. 15, 2003

(65) Prior Publication Data

US 2005/0056645 A1 Mar. 17, 2005

(51) Int. Cl.[7] ..... B65D 51/20

(52) U.S. Cl. ..... 220/257.1; 220/266; 220/304; 220/601; 220/214; 215/230; 215/250; 206/459.1

(58) Field of Search ..... 220/257.2, 601, 220/266, 270, 304, 259.3, 257.1, 214; 215/230, 215/250, 318, 249, 251; 206/459.1

(56) References Cited

U.S. PATENT DOCUMENTS

| | | | | | |
|---|---|---|---|---|---|
| 1,956,135 | A | * | 4/1934 | Schmitz et al. | 220/284 |
| 2,760,671 | A | * | 8/1956 | Parish, Jr. | 220/257.2 |
| 2,962,185 | A | * | 11/1960 | Starr et al. | 220/254.8 |
| 3,189,072 | A | * | 6/1965 | Starr | 215/321 |
| 3,630,404 | A | * | 12/1971 | Guala | 215/251 |
| 4,320,861 | A | | 3/1982 | Rieke et al. | 222/541 |
| 4,461,389 | A | * | 7/1984 | Korn | 215/246 |
| 4,489,841 | A | * | 12/1984 | Thompson | 215/203 |
| 4,520,942 | A | * | 6/1985 | Dwinell | 220/257.2 |
| 4,573,605 | A | * | 3/1986 | Udell | 220/304 |
| 4,658,980 | A | * | 4/1987 | Lindstrom | 220/214 |
| 4,711,372 | A | * | 12/1987 | Gach | 222/23 |
| 4,883,194 | A | * | 11/1989 | Fernandes | 220/787 |
| 5,893,475 | A | * | 4/1999 | May | 215/252 |
| 6,070,748 | A | * | 6/2000 | Storar | 215/249 |
| 6,360,908 | B1 | | 3/2002 | Kline | 220/257 |
| 6,726,048 | B2 | * | 4/2004 | Dwinell et al. | 220/257.2 |

FOREIGN PATENT DOCUMENTS

| | | | | | |
|---|---|---|---|---|---|
| DE | 3637644 | A | * | 5/1988 | B65D 39/08 |
| GB | 2222399 | A | * | 3/1990 | B65D 51/18 |

* cited by examiner

*Primary Examiner*—Nathan J. Newhouse
*Assistant Examiner*—James Smalley
(74) *Attorney, Agent, or Firm*—Woodard, Emhardt, Moriarty, McNett & Henry LLP

(57) ABSTRACT

A container closure assembly for closing the neck opening of a container includes a closure plug for threaded engagement with the neck opening, a sealing gasket positioned between the container and the closure plug, and a unitary, molded plastic overcap constructed and arranged for assembly to the closure plug. The overcap includes a top portion defining a pair of weakened score lines that partition the top portion into three sections. A surrounding sidewall connects a pair of flange sections to first and second outer sections of the top portion. A center post axially extends from the center section and includes external threads for engagement with internal threads on the closure plug. The overcap includes a raised portion in unitary construction with the top portion and spanning the pair of weakened score lines so as to visually reveal stress discoloration upon upward movement of the first and second outer sections.

12 Claims, 5 Drawing Sheets

CONTAINER CLOSURE ASSEMBLY WITH SNAP-ON OVERCAP

BACKGROUND OF THE INVENTION

The present invention relates in general to tamper-evident structures for container closures and caps. More specifically, the present invention relates to a container closure assembly that includes a snap-on overcap. The overcap includes a tamper-evident feature. The specific style of container closure for use with the disclosed snap-on overcap, as described for the present invention, includes a bung style plug that threads into an internally-threaded container opening. In one embodiment of the present invention, the bung style plug includes a central portion arranged with internal, modified buttress threads and the overcap includes a centrally-positioned post that is constructed and arranged with a series of cooperating external, modified buttress threads. These external threads are designed to engage and interlock with the internal threads of the bung style plug for an axially-directed snap fit of the overcap into and over the bung style plug. The requisite flexing of the external threads for this snap-on assembly with the plug is enabled by the modified buttress thread form and the plastic construction.

One of the improvements provided by the present invention is the ability to provide a tamper-evident structure in combination with a bung style plug. Another improvement provided by the present invention is found in the simplicity of the overcap and the ease of assembly into and over the bung style plug.

SUMMARY OF THE INVENTION

An overcap for assembly to a container closure plug according to one embodiment of the present invention comprises a top portion defining a pair of weakened score lines partitioning the top portion into a center section and first and second outer sections, a surrounding sidewall, a pair of oppositely-positioned flange sections in unitary connection with the surrounding sidewall, one flange section being connected by a portion of the sidewall to the first outer section and the other flange section being connected by another portion of the sidewall to the second outer section, a center post axially extending from the center section and being constructed and arranged for assembly to the closure plug and tamper-evident means for providing a visual indication of an attempt to remove the overcap from the closure plug.

One object of the present invention is to provide an improved container closure assembly that includes a snap-on overcap.

Related objects and advantages of the present invention will be apparent from the following description.

DESCRIPTION OF THE PREFERRED EMBODIMENTS

Figure 1:
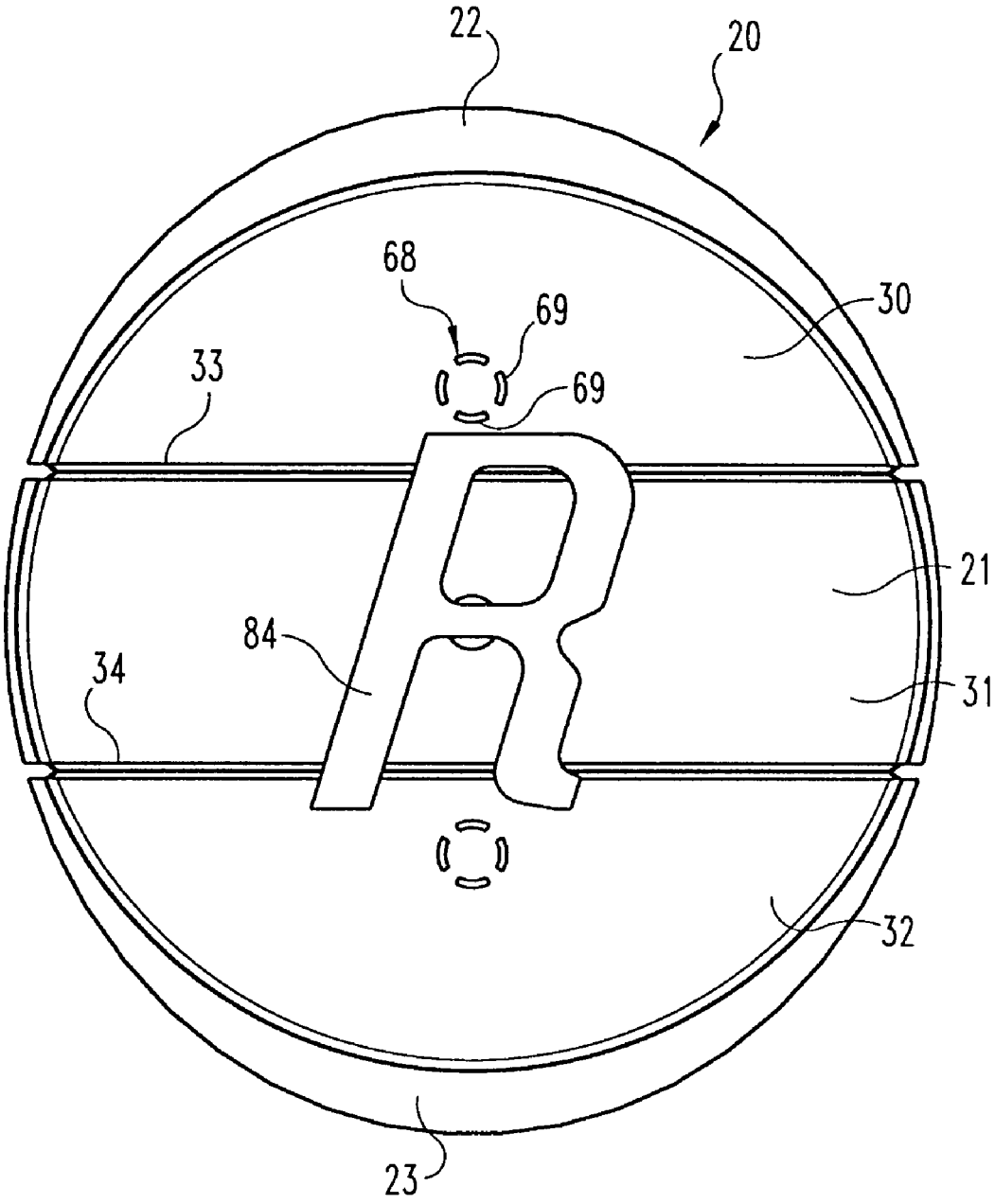
FIG. 1 is a top plan view of an overcap according to a typical embodiment of the present invention.
Figure 2:
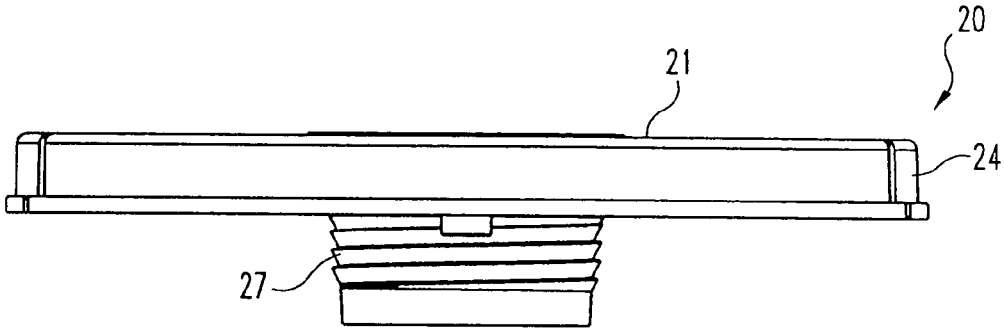
FIG. 2 is a front elevational view of the FIG. 1 overcap.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–5, there is illustrated a snap-on overcap 20 that is molded out of plastic as a unitary member according to the present invention. Overcap 20 includes a top panel 21, opposite radial flange sections 22 and 23, annular sidewall 24, pins 25 and 26, and center post 27. Top panel 21 is partitioned into three sections 30, 31, and 32 by a pair of V-shaped notches 33 and 34, or what could also be described as weakened score lines. These weakened score lines 33 and 34 act like living hinges at the time of proper removal of overcap 20 from its cooperating bung plug 37.

Partitioned section 31 is considered the center section of the three with partitioned sections 30 and 32 being described as first and second outer sections. As should be clear from the drawing illustrations, one flange section 22 is connected by a portion of annular sidewall 24 to the first outer section 30. In a similar or virtually identical manner, the other radial flange section 23 is connected by another portion of annular sidewall 24 to the second outer section 32.

As will be described in the context of FIGS. 4, 6, 7 and 8, overcap 20 is constructed and arranged to snap into bung plug 37 and to extend over and around the top portion 38 of bung plug 37. Top portion 38 includes an upper surface 39, wrench recess 40, radial lip 41, outer surface 42, and annular gasket-receiving channel 43. Annular sidewall 24 in cooperation with top panel 21 defines a recessed space 46 that is constructed and arranged to receive top portion 38 of bung plug 37. Since the bung plug 37 is received within the container (neck) opening 71, it should be noted that recessed space 46 has a diameter size sufficient to also receive raised wall 79. In order to achieve or create this overcap-bung plug assembly, it is necessary for center post 27 to fit into the coaxially centered tubular opening 47. It is also necessary for the two pins 25 and 26 to fit into wrench recess 40. The wrench recess 40 includes an inner cylindrical portion 48 opening into four equally spaced, radial pockets 49. By positioning the two pins 25 and 26 approximately 180 degrees apart, one pin fits into one pocket 49 and the other pin fits into an oppositely-disposed pocket 49.

Center post 27 is slightly tapered from top panel 21 to lower edge 51, though otherwise center post 27 is generally cylindrical in shape. The outer annular wall 52 includes a series of external, modified buttress threads 53. Each thread 53 has an angled surface as the leading edge 54 and a substantially flat portion 55 as a trailing edge. In an upright orientation, this flat portion 55 of each thread, or what can be called the pressure flange, is generally horizontal. The horizontal direction is defined in terms of the axial centerline 56 being substantially vertical. The leading and trailing edges are defined in terms of the direction of pushing the overcap 20 downwardly onto the installed bung plug 37.

The tubular opening 47 is a blind opening due to lower wall 59. The opening 47 includes two generally concentric sections 60 and 61. Section 60 is defined by generally cylindrical wall 62 and includes a series of internal modified buttress threads 63. Section 61 is defined by generally cylindrical wall 64. Walls 62 and 64 are substantially concentric to each other with wall 62 having a larger outside diameter as compared to the outside diameter of wall 64. The resulting radial offset between these two generally concentric sections 60 and 61 is defined by radial wall 65.

As would generally be understood with snap-on, unidirectional designs, there is a desire to have one direction of movement of one component permitted (relative to the other component) and the reverse direction of movement prevented. In the case of the present invention, the leading edge 54 of each external thread 53 has a profile and material (plastic) that enables it to flex and ramp over each internal thread 63 as the overcap 20 is pushed axially downwardly into and onto bung plug 37. This allows the overcap 20 to have a "snap-on" assembly to bung plug 37. Abutment of top panel 21 against top portion 38 indicates a completed assembly of the overcap 20 onto the bung plug 37. While this might represent an axial position between sequential points of external thread-to-internal thread engagement, it is not the function of overcap 20 to create a sealed barrier against leakage. Rather, one function of overcap 20 is to create a barrier to debris. Another function of overcap 20 is to provide a tamper-evident feature.

Figure 3:
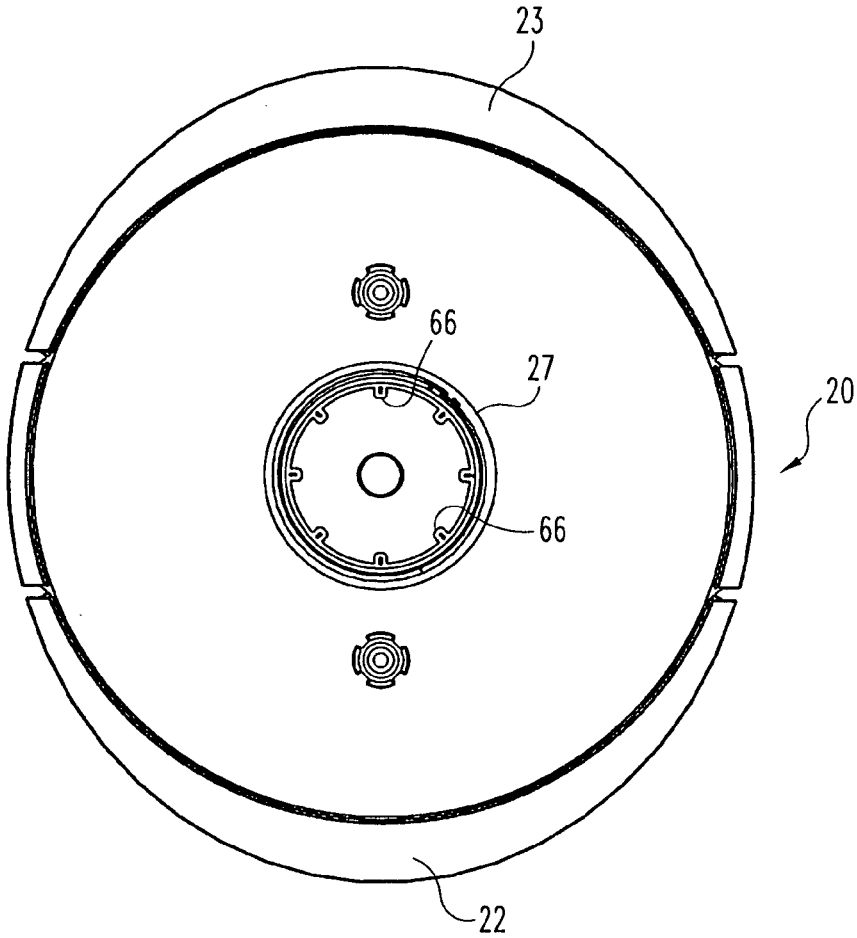
FIG. 3 is a bottom plan view of the FIG. 1 overcap.
Figure 5:
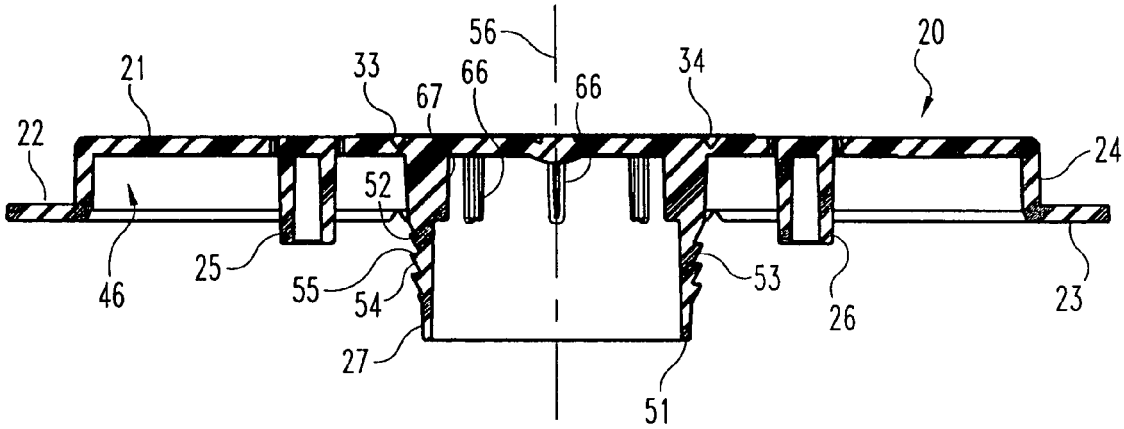
FIG. 5 is a front elevational view, in full section, of the FIG. 1 overcap.

Referring to FIGS. 3 and 5, it will be seen that center post 27 includes an equally-spaced series of eight radial ribs 66 positioned around the inside diameter surface 67. These ribs 66 provide additional strength and rigidity to center post 27, particularly during the snap-fit installation of overcap 20 onto bung plug 37.

The desired external thread (overcap 20) and internal thread (bung plug 37) engagement functions to retain the overcap 20 on bung plug 37. When it is intended to remove overcap 20 in order to have access to the container contents by the removal of bung plug 37, there is a specific procedure to be followed. This procedure creates an altered appearance to the overcap 20 and is described in greater detail hereinafter. Since tampering attempts might be made to try and remove overcap 20 without visually revealing that this has been done, it is important to include a tamper-evident feature as part of the present invention. The described external thread 53 engagement with the internal threads 63 on the bung plug is an important structural element of the tamper-evident capability of the present invention.

Any attempt to pull upwardly on the snap-on overcap 20, so as to try and remove it from the bung plug 37, is prevented by the blocking, abutting engagement of the flat (horizontal) portion 55 of each external thread 53 against the internal threads 63. This is typical of any proper threaded engagement where one component cannot be pulled free of the other due to the mating of the threads. Each portion 55 is shaped with a horizontal surface such that the external threads 53 are not able to bend or deflect a sufficient amount to enable these threads to clear their immediately adjacent (axially upward) internal thread 63. This external thread-to-internal thread interlock (mating) keeps the overcap 20 in position on bung plug 37 until it is desired to be removed, presumably by an authorized end user.

One aspect of the tamper-evident construction of overcap 20 is directed to the unitary fabrication of overcap 20, including the unitary combination of pins 25 and 26. Importantly, each pin 25 and 26 is joined to top panel 21 by a circular interface 68 (see FIGS. 1 and 3) that includes four, spaced-apart web sections 69, that are weakened due to their web structure, i.e., thinner material. As will be described in greater detail hereinafter, a tampering attempt, i.e., trying to remove the overcap 20 in some way other than the intended manner, causes the pins 25 and/or 26 to flex in such a way that they try to pull away from top panel 21. The stress that occurs due to the bending results in breaking open one or more of the web sections 69. The broken web section or opening that is left is an immediate visual indication that a tampering attempt has been made. This allows the authorized end user to inspect the container and the container contents to determine whether that tampering attempt was successful.

Figure 4:
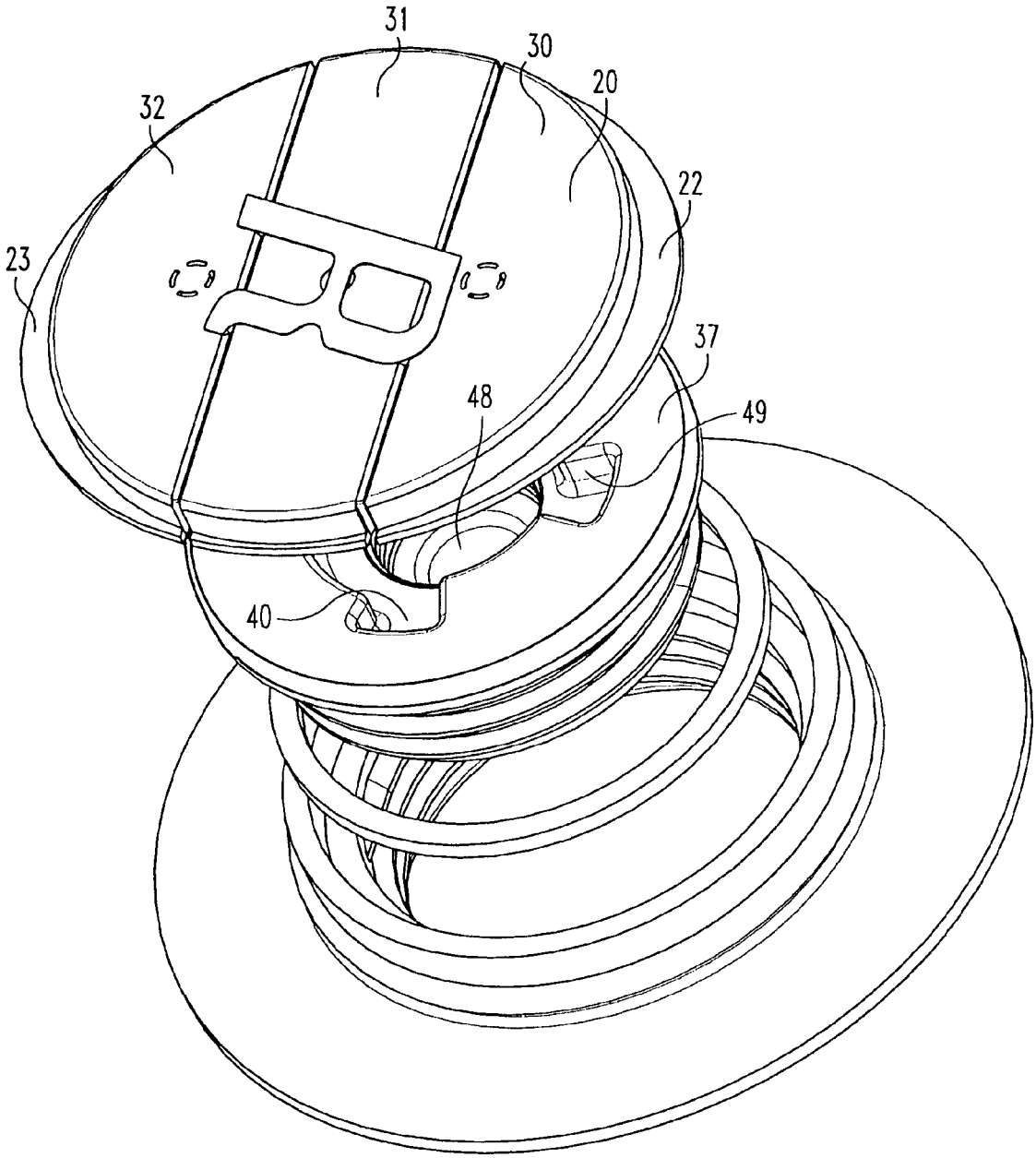
FIG. 4 is an exploded view of the FIG. 1 overcap in combination with a closure plug, sealing gasket, and container opening.
Figure 6:
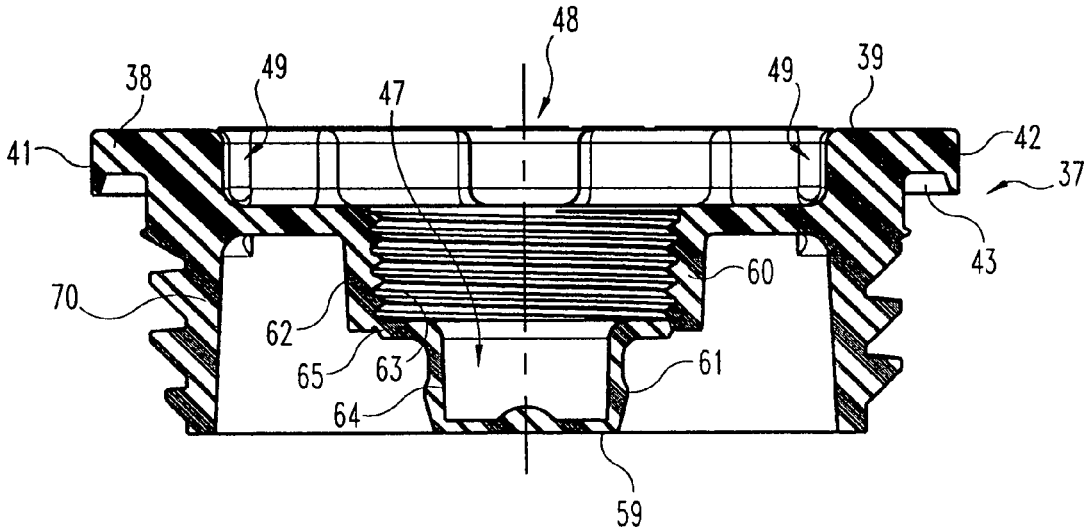
FIG. 6 is a front elevation view, in full section, of the closure plug illustrated in FIG. 4.
Figure 7:
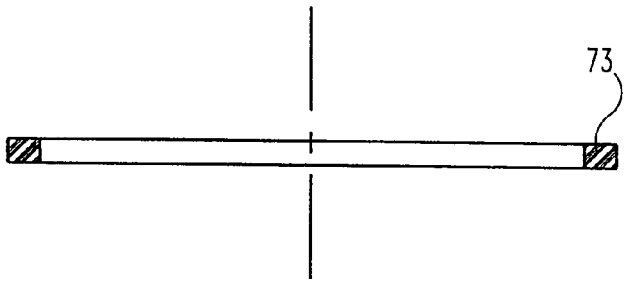
FIG. 7 is a front elevational view, in full section, of the sealing gasket illustrated in FIG. 4.
Figure 8:
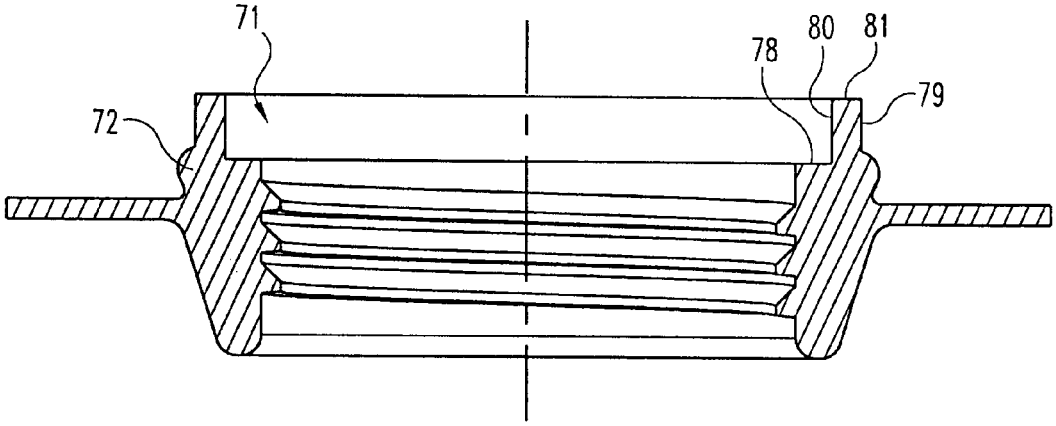
FIG. 8 is a front elevational view, in full section, of the container opening illustrated in FIG. 4.

Referring to FIGS. 6, 7, and 8, the cooperating components with overcap 20 that complete the disclosed closure assembly according to the present invention are illustrated. Much of bung plug 37 has already been described. Additionally though it will be seen that the sidewall 70 is externally-threaded. Bung plug 37 is a unitary, molded plastic component. The outlet portion 71 of the cooperating container 72 is illustrated in FIG. 8. This outlet portion 71 (i.e., neck opening) is internally-threaded and is constructed and arranged for the tight and secure threaded receipt of bung plug 37. The square cut annular gasket 73 (see FIG. 7) is constructed and arranged to sealingly fit within channel 43, with a portion axially extending for compression against the inset radial shelf 78 of neck opening 71. Shelf 78 is concentrically surrounded by cylindrical, raised wall 79 of neck opening 71. As the bung plug 37 is threadedly advanced into the neck opening 71, the gasket that fits within channel 43 of bung plug 37 is advanced into engagement against radial shelf 78. Continued advancement causes the elastomeric gasket 73 to be compressed, thereby establishing a liquid-tight seal between bung plug 37 and container 72. The full threaded advancement of bung plug 37 into neck opening 71 positions the radial lip 41 of the bung plug 37 radially inside of raised wall 79. The outer surface 42 is in close proximity to the inner surface 80 of the raised wall 79. The upper surface 39 is substantially flush with the upper surface 81 of raised wall 79. An exploded view of the assembly of the container neck opening 71, gasket 73, and bung plug 37 including overcap 20 is illustrated in FIG. 4. Overcap 20 fits over and around raised wall 79 when fully snapped on to and into bung plug 37.

The top panel 21 of overcap 20 includes a raised portion 84 that is generally centrally positioned on top panel 21 and importantly extends across or spans both V-shaped notches, described as score lines 33 and 34. While a block letter R has been used to represent this raised portion, it is to be understood that virtually any letter, logo, shape or design can be used. The important design features for this raised portion 84 include its relatively thin structure and a size sufficient to extend across or span both of the score lines 33 and 34. The use of a letter for raised portion 84 enables the manufacturer of the overcap, or of the overall assembly, to be able to brand the product with a source of origin indicator.

Consistent with the disclosed invention, the overcap 20 is constructed and arranged to snap over and onto bung plug 37, and over and around the raised wall 79, or over and onto a similarly styled bung plug. Assembly of the overcap 20 is achieved by axially pushing center post 27 into tubular opening 47. This achieves the intended external thread-to-internal thread engagement. In order to open the disclosed assembly (see FIG. 4), the user begins by lifting up on both radial flange sections 22 and 23. Since each score line 33 and 34 extends completely across the top panel, four peripheral notches 85*a*–85*d* are created in the surrounding sidewall 24. The score lines 33 and 34, in cooperation with the peripheral notches 85*a*–85*d*, allow the radial flange sections 22 and 23 to bend or hinge upwardly and inwardly toward each other. As previously described, the thinner material for score lines 33 and 34 enables these two lines to serve as living hinges, helping to facilitate the upwardly and inwardly bending or hinging of radial flange sections 22 and 23. As a result of this upwardly and inwardly hinging, the two radial flange sections 22 and 23 create a pair of cooperating panels that the user can grasp in order to twist off (i.e., unscrew) the overcap 20 and remove it from bung plug 37. As previously described, there are external threads 53 on the overcap 20 of a modified buttress form and cooperating internal modified buttress threads 63 in section 60 of the bung plug 37. This means that a twisting action applied to overcap 20, using the two radial flange sections 22 and 23, simply unscrews the external threads 53 from the internal threads 63, allowing overcap 20 to be removed from bung plug 37 in the intended manner. Removal of overcap 20 exposes the bung plug 37 so that it can be removed (unscrewed) from the container 72 neck opening 71.

When the two radial flange sections 22 and 23 are hinged upwardly and inwardly, using the two score lines 33 and 34 as living hinges, there is some bending or flexing of raised portion 84 at each location where it extends across score lines 33 and 34. Due to the material selected for overcap 20 and due to the thicker material represented by raised portion 84 as compared to the material thickness of score lines 33 and 34, the bending stress in raised portion 84 creates stress discoloration or what is described as "whiting". While this is not of concern to the authorized user who intends to remove overcap 20, this stress discoloration and the use of raised portion 84 does provide a visual indication to the authorized user if there has been a previous tampering attempt. If the authorized user sees the stress discoloration in the raised portion, that would be an indication that an attempt has been made and puts the authorized user on notice to inspect the container and container contents to see if that tampering attempt has been successful. With regard to this tamper-evident feature, it is important to note that the raised portion 84 is not notched or scored in any manner and thus at those lines of overlap where it extends across the score lines 33 and 34, the bending action of the radial flange sections 22 and 23 creates a stress line, resulting in the described stress discoloration. Since it might be possible for an unauthorized user to remove overcap 20 by only bending up on one of the two radial flange sections, it is appropriate to have the raised portion extend across both score lines 33 and 34. However, if an alternative design for overcap 20 is created where there is only one score line and only one radial flange section, then the raised portion would only need to extend across that one score line in order to provide the tamper-evident feature.

If there is an attempt to remove the overcap 20 in some other manner, i.e., without using the radial flange sections 22 and 23 to twist off overcap 20, the two pins 25 and 26 come into play as other tamper-indicating structures. An axial direction of removal for overcap 20 does not affect pins 25 and 26. However, if overcap 20 is not removed in the intended manner, pins 25 and 26, either one or both, must flex relative to top panel 21 and this in turn causes one or more holes in web sections 69, thereby providing a visual indication of a tampering attempt or at least an indication of an improper opening attempt.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An overcap for assembly to a container closure plug comprising:

a top portion defining a pair of living hinge strips partitioning said top portion into a center section and first and second outer sections;

a surrounding sidewall;

a pair of oppositely-positioned flange sections in unitary connection with said surrounding sidewall, one flange section being connected by a portion of said sidewall to said first outer section and the other flange section being connected by another portion of said sidewall to said second outer section, said center section being defined by said pair of living hinge strips;

a center post positioned between said pair of living hinge strips and being in unitary connection with said center section, said center post axially extending from said center section and being constructed and arranged for assembly to said closure plug; and tamper-evident means for providing a visual indication of an attempt to remove said overcap from said container closure plug, said tamper-evident means including a first pin in unitary connection with said first outer section and a second pin in unitary connection with said second outer section, said first and second pins being constructed and arranged for receipt by said container closure plug.

2. The overcap of claim 1 wherein said center post includes a series of external threads.

3. The overcap of claim 1 wherein said tamper-evident means includes a raised portion integral with said top portion, said raised portion extending across said pair of living hinge strips.

4. The overcap of claim 3 wherein the site of connection of each of said first and second pins to its corresponding outer section includes a web section that is constructed and arranged to break open upon bending of the corresponding pin.

5. The overcap of claim 1 wherein the site of connection of each of said first and second pins to its corresponding outer section includes a web section that is constructed and arranged to break open upon bending of the corresponding pin.

6. A container closure assembly comprising:

a closure plug constructed and arranged to assemble to an outlet opening of a container to close off said outlet opening;

a sealing gasket constructed and arranged to be positioned between said container and said closure plug; and an overcap constructed and arranged for assembly to said closure plug, said overcap including:

a top portion defining a pair of living hinge strips partitioning said top portion into a center section and first and second outer sections;

a surrounding sidewall;

a pair of oppositely-positioned flange sections in unitary connection with said surrounding sidewall, one flange section being connected by a portion of said sidewall to said first outer section and the other flange section being connected by another portion of said sidewall to said second outer section, said center section being defined by said pair of living hinge strips;

a center post positioned between said pair of living hinge strips and being in unitary connection with said center section, said center post axially extending from said center section and being constructed and arranged for assembly to said closure plug; and tamper-evident means for providing a visual indication of an attempt to remove said overcap from said container closure plug, said tamper-evident means including a first pin in unitary connection with said first outer section and a second pin in unitary connection with said second outer section, said first and second pins being constructed and arranged for receipt by said container closure plug.

7. The container closure assembly of claim 6 wherein said center post includes a series of external threads.

8. The container closure assembly of claim 7 wherein said closure plug includes a series of internal threads that are constructed and arranged to receive said series of external threads with a snap-on engagement.

9. The container closure assembly of claim 8 wherein the site of connection of each of said first and second pins to its corresponding outer section includes a web section that is constructed and arranged to break open upon bending of the corresponding pin.

10. The container closure of claim 6 wherein the site of connection of each of said first and second pins to its corresponding outer section includes a web section that is constructed and arranged to break open upon bending of the corresponding pin.

11. An overcap for assembly to a container closure plug comprising:

a top portion defining a pair of living hinge strips partitioning said top portion into a center section and first and second outer sections;

a surrounding sidewall;

a pair of oppositely-positioned flange sections in unitary connection with said surrounding sidewall, one flange section being connected by a portion of said sidewall to said first outer section and the other flange section being connected by another portion of said sidewall to said second outer section, said center section being defined by said pair of living hinge strips;

a center post positioned between said pair of living hinge strips and being in unitary connection with said center section, said center post axially extending from said center section and being constructed and arranged for assembly to said closure plug, said center post including a series of external threads; and tamper-evident means for providing a visual indication of an attempt to remove said overcap from said container closure plug, said tamper-evident means including a first pin in unitary connection with said first outer section and a second pin in unitary connection with said second outer section, said first and second pins being constructed and arranged for receipt by said container closure plug, said tamper-evident means further including a raised portion integral with said top portion, said raised portion extending across said pair of living hinge strips.

12. The overcap of claim 11 wherein the site of connection of each of said first and second pins to its corresponding outer section includes a web section that is constructed and arranged to break open upon bending of the corresponding pin.

* * * * *

UNITED STATES PATENT AND TRADEMARK OFFICE

CERTIFICATE OF CORRECTION

PATENT NO. : 6,968,968 B2
APPLICATION NO. : 10/662735
DATED : November 29, 2005
INVENTOR(S) : Simon Buckley and Richard A. Laveault It is certified that error appears in the above-identified patent and that said Letters Patent is hereby corrected as shown below:

Title page, item (75) inventors: should read as follows:

Inventors: Simon Buckley, Ft. Wayne, IN (US);
Richard A. Laveault, Ft. Wayne, IN (US)

Signed and Sealed this
Twenty-sixth Day of November, 2013

Margaret A. Focarino

Margaret A. Focarino
*Commissioner for Patents of the United States Patent and Trademark Office*